United States Patent [19]

Boissevain

[11] Patent Number: 4,580,355

[45] Date of Patent: Apr. 8, 1986

[54] SYSTEM FOR DISTRIBUTING HOT GAS ON A PAPER WEB

[75] Inventor: Mat Boissevain, Los Altos Hills, Calif.

[73] Assignee: Measurex Corporation, Cupertino, Calif.

[21] Appl. No.: 612,989

[22] Filed: May 23, 1984

[51] Int. Cl.[4] ..... F26B 19/00; F26B 13/10; F26B 21/00

[52] U.S. Cl. ..... 34/54; 34/48; 34/155; 162/207; 162/290; 138/42; 138/43

[58] Field of Search ..... 34/54, 48, 155; 138/46, 138/42, 43; 162/207, 290, 252, 359; 251/121, 117, 205

[56] References Cited

U.S. PATENT DOCUMENTS

| | | | |
|---|---|---|---|
| 3,964,516 | 6/1976 | Purton et al. | 137/625.38 |
| 4,127,627 | 11/1978 | Sarto | 138/46 |
| 4,154,263 | 5/1979 | Cary | 137/625.38 |
| 4,253,247 | 3/1981 | Bergstrom | 34/54 |
| 4,292,991 | 10/1981 | Wing | 138/46 |
| 4,398,355 | 8/1983 | Dove | 34/54 |
| 4,422,575 | 12/1983 | Dove | 34/155 |

*Primary Examiner*—S. Leon Bashore
*Assistant Examiner*—K. M. Hastings
*Attorney, Agent, or Firm*—Hal Bohner

[57] ABSTRACT

The specification discloses a steam distributor having a chamber to contain steam on one side of a paper web and a vacuum box on the opposite side of the paper web. The distributor has a feeding system for controlling the rate at which hot gas is applied to the paper.

4 Claims, 5 Drawing Figures

SYSTEM FOR DISTRIBUTING HOT GAS ON A PAPER WEB

BACKGROUND OF THE INVENTION

1. The Field of The Invention

This invention relates to means for distributing hot gas on a moving sheet of paper.

2. State of the Art

In most paper products it is desirable to automatically control the cross machine moisture content using a steam shower or steam distributor. Most paper machines have continuous moisture scanners which read the sheet moisture content across the machine as the paper is manufactured. The information from this continuous measurement can be fed into a controlling computer and the steam flow in the steam distributor can be automatically controlled according to this information.

One type of steam distributor is taught in U.S. Pat. No. 4,253,247. The patent teaches a multi-chambered steam hood with means of steam distribution to each chamber provided by a steam distributor. Steam flows from the steam distributor through ports into a nozzle and into each chamber. The steam flow is controlled by raising or lowering a control plug.

According to the patent the plug has a piston ring located around its periphery. It is believed that a piston ring in such a location would substantially prevent any flow of steam into the chamber when the plug is in the closed position. This could lead to cooling of parts of the chamber and condensation of steam to liquid water therein. The liquid water could drop from the chamber onto the paper thereby producing local discoloration called streaking.

OBJECT OF THE INVENTION

An object of the present invention is to provide a steam distribution system with valve means to prevent condensation of steam and streaking of the paper.

Further objects and advantages of the invention can be ascertained by reference to the specification and drawings which are provided by way of example and not in limitation of the invention, which is defined by the claims and equivalents.

DETAILED DESCRIPTION OF THE PREFERRED EMBODIMENTS

Figure 1:
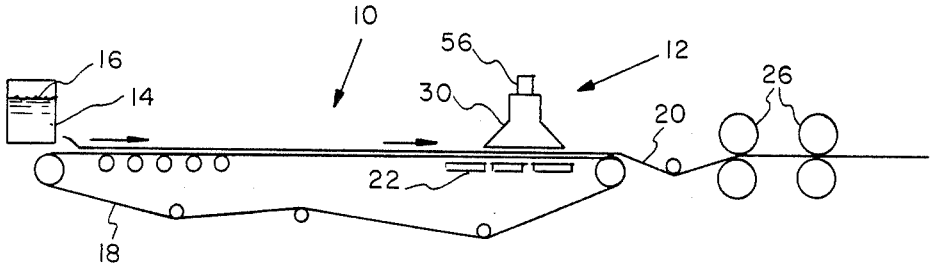
FIG. 1 is a schematic view of a paper making machine including a steam distributor.

There is shown in FIG. 1 a paper making machine 10 including a hot gas distributor 12. In practice steam is normally used; however in some applications other hot gases could be substituted. Herein the word steam will be used to mean steam or such other hot gas. The machine shown is of the Fourdrinier type and includes a pulp box 14 feeding pulp mixture 16 to a web-like conveyor 18 on which the liquid is drawn from the pulp to leave a paper web 20, which travels partially dried under the distributor 20 and over vacuum box 22, a press section 26, further dryers (not shown) and a known moisture measuring device (not shown) which measures the moisture content across the sheet. The distributor is adjusted manually or automatically to reduce the moisture variations in the cross direction.

Figure 2:
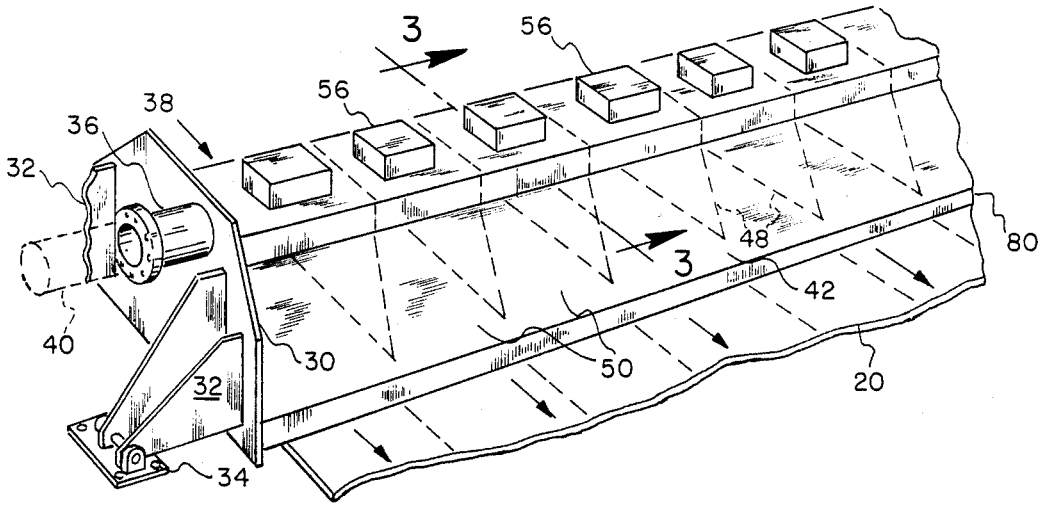
FIG. 2 is an isometric illustration of a present embodiment.

As shown in FIG. 2 the steam distributor 12 includes a hood 38 having end plates 30 at each end, each supported by a pair of legs 32 carried by feet 34 mounted on the conveyor frame (not shown) outside the path of the conveyor. A pipe 36 is supported by the end plates 30. A steam pipe 40 supplies a hot gas, in the present instance, steam from a suitable source to the pipe 36. The hood 38 includes outer shell 42, an inner shell 44 and insulation 46 which together form side walls 47 and 49. Transverse partitions 48 divide the hood into a plurality of chambers or compartments 50 spanning the entire width of the web 20. Tubes 52, individual to the compartments having ports 51 each supplies steam to its compartment in accordance with the setting of a pneumatic valve 56 individual to that chamber and controlled by the moisture profile measuring device or manually. The steam travels through the pipe 36, through ports 51 into the tubular nozzles 52, through the nozzles into the chambers 50, through slotted, arcuate diffusing plates 60, through the web 20 and a supporting screen or vacuum box cover 62 forming the top of a vacuum box 22. The diffusion plates may be drilled plates of different patterns. The plates may be omitted to leave an open bottom chamber.

Figure 3:
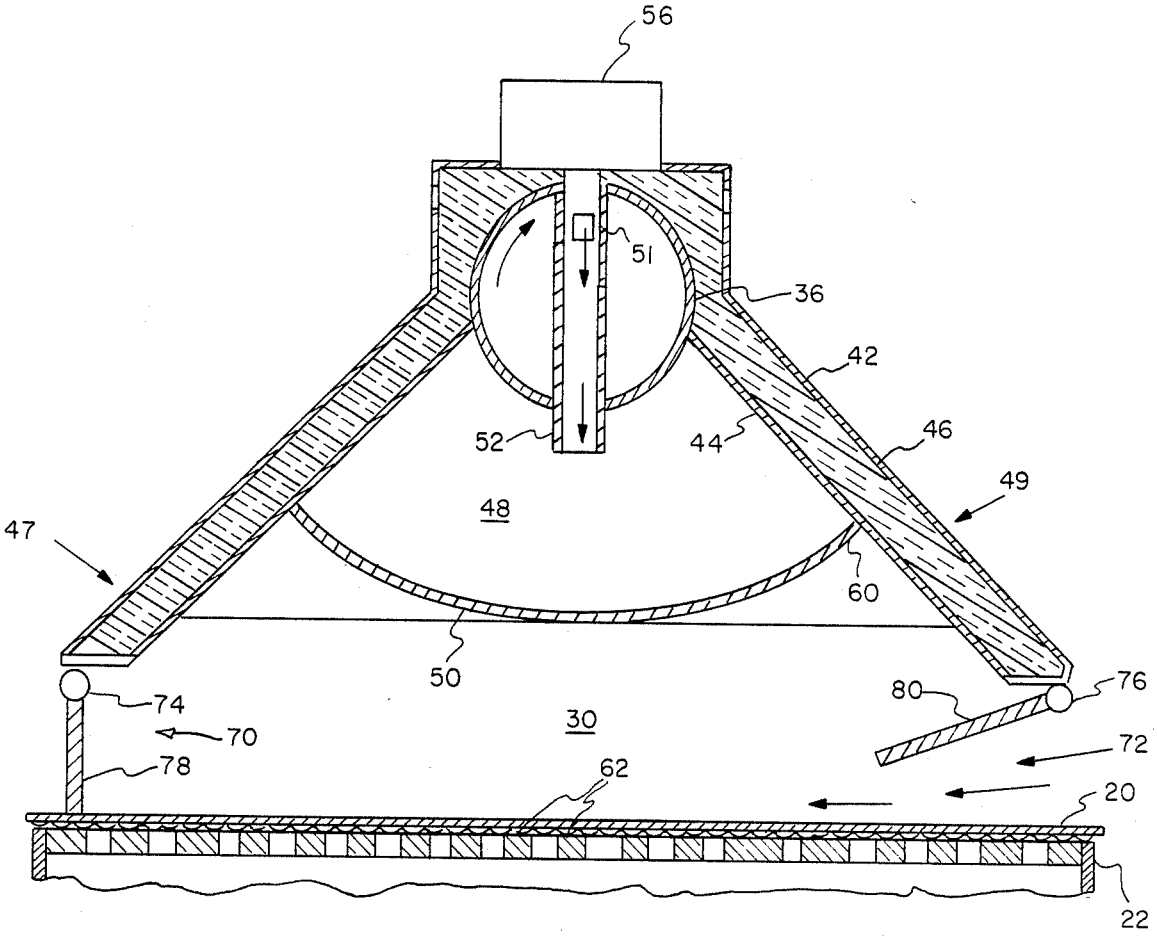
FIG. 3 is a cross sectional illustration of a present embodiment.

Turning to FIG. 3, the sidewalls 47 and 49 of the chamber 50 are spaced apart from paper web 20 so that spaces 70 and 72 are formed therebetween. In practice, we have found it desirable to space the sidewalls 47 and 49 about four inches above the paper web 20. Hinges 74 and 76 are mounted along the bottoms of side walls 47 and 49 and plates 78 and 80 are affixed one to each hinge. The plates are of sufficient height to extend from the hinges to about three quarter inch above the paper web 20.

Figure 4:
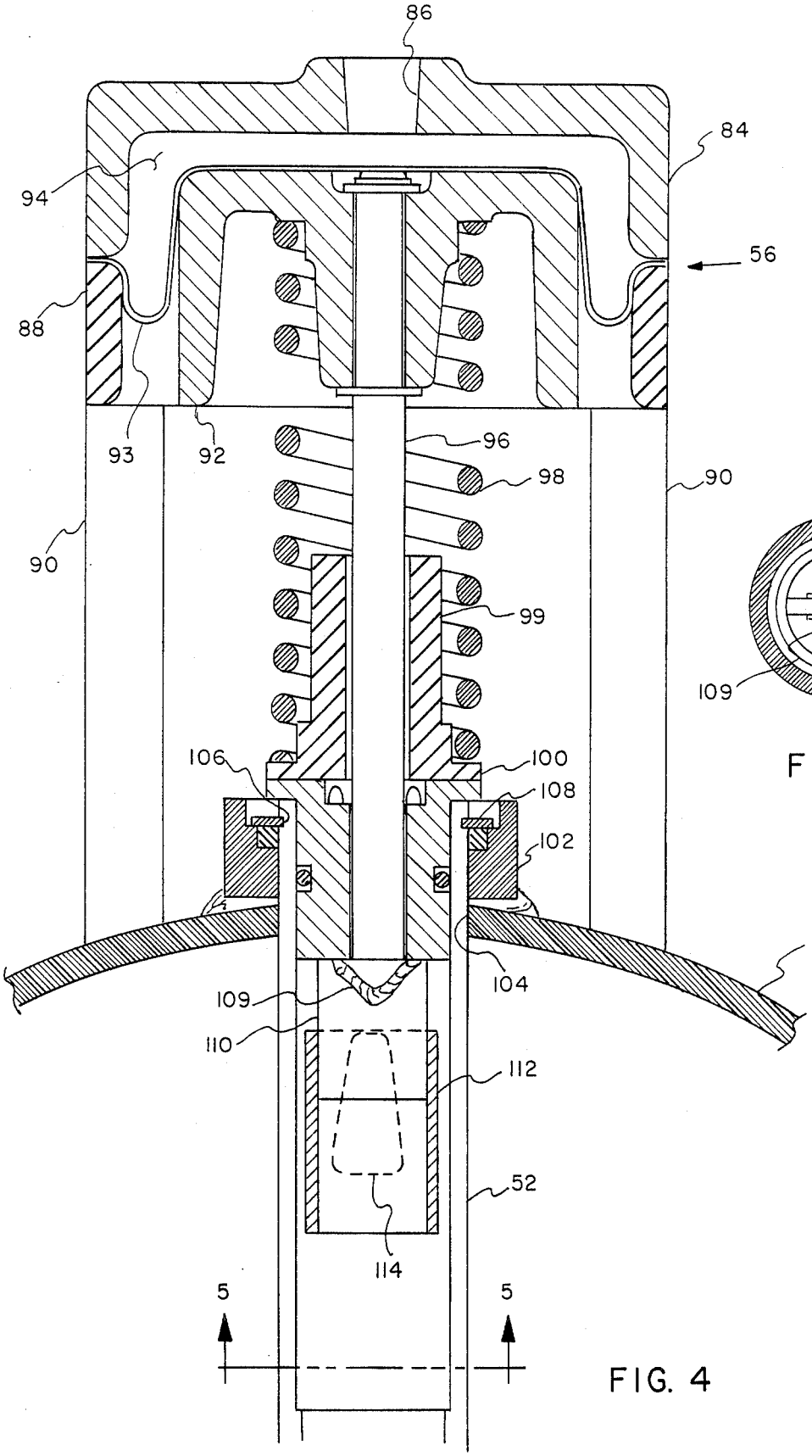
FIG. 4 is another cross sectional illustration of the present embodiment.
Figure 5:
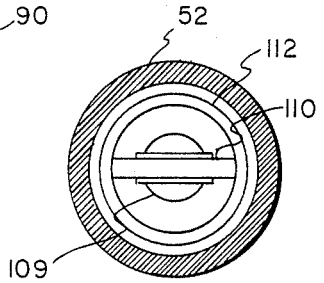
FIG. 5 is a cross sectional view of FIG. 4 taken along line 5—5.

FIG. 4 shows the valve 56 in cross section. The valve 56 includes a bellows member 82 including a cap 84 with a part 86 formed therein to permit connection to a source of fluid, not shown, for actuating the bellows. The bellows 82 also includes a base member 88 which is affixed to the upper part of hood 38 by support members 90. A plunger 92 is disposed inside the base 88, and a flexible diaphragm 93 is coupled between the edges of the cap 82 and base 88 to contain the working fluid in cavity 94. The plunger 92 is affixed to the diaphragm 93 so that when the cavity 94 is filled with working fluid, the plunger 92 is forced downward. A rod 96 is coupled to the plunger 92 and extends downward therefrom. The rod 96 is constructed and arranged to move slidably in a first brushing 99 and a second brushing 100. The second bushing 100 is coupled to the upper end of the nozzle 52, and the nozzle is set in a retainer member 102 which is welded to the pipe 36. The pipe 36 has a port 104 to permit the nozzle to extend therethrough, and the nozzle 52 has a groove 106 in its upper end which is compatible with a snap ring 108 to hold the nozzle 52 in place.

The rod 96 has a conical end 109 which is welded to a plate 110, and the plate in turn is connected to a hollow, cylindrical sleeve 112. The sleeve 112 has an outside diameter which is about 0.004 inch less than the inside diameter of the nozzle 52, and the sides of the sleeve 112 are substantially smooth and without a groove or any seal member or the like. The nozzle 52 includes two ports 114, one of which is shown in FIG. 4, and the sleeve 112 is located so that when it is in its uppermost or maximum closed position some steam can flow through the ports 114 and downward through the space between the sleeve and the nozzle 52 and through the interior of the sleeve. Of course, the flow of steam is significantly restricted because the port 114 is substantially blocked by the nozzle 52. When the sleeve 112 moves downward, the ports 114 are exposed thus permitting a controllable flow of steam to enter the nozzle 52 and flow primarily through the interior of the sleeve 112.

In operation fluid is controllably introduced into the cavity 94 thus causing the sleeve 112 to move downward a controllable distance against the force of the spring 98. Thus, the rate of flow of steam through the nozzle 52 is controlled. When the sleeve 112 is in its maximum closed, i.e. uppermost position, the upper edge of the sleeve 112 is above the upper edges of the ports 114. However, a slight flow of steam is still permitted which thus keeps the nozzles 52 and other parts of the hood 38 warm thereby reducing or eliminating condensation.

It should be understood that the sleeve 112 can be closed at its top. In this case the maximum open position of the sleeve 112 would be completely above the ports 114, so that filling the cavity 94 with fluid would close the ports 114, and releasing fluid from the cavity 94 would open the ports.

Steam is introduced into the hood 38 and vacuum is applied to the vacuum box 22 so that the pressure in the hood is near ambient. In this case the plates 78 and 80 are vertical as indicated by plate 78 in FIG. 3 so that no substantial quantity of steam escapes to the atmosphere and no substantial quantities of ambient air enters the hood. However, if through operator error or mechanical failure steam is not introduced through pipe 36 while vacuum is applied to the box 64, ambient air is drawn into the hood as indicated by the arrows, and the plate is opened by the air flow as shown by plate 80. Thus the vacuum does not exert downward force on the hood 38. It should be understood that the downward force on the hood 38 could be extreme, if not for the present invention. For example, for a hood 60 inches in width and 300 inches in length 90,000 pounds of force would be exerted by a vacuum of five pounds per square inch, which is not uncommon.

In some applications it could be necessary to have only one plate 78 or 80 rather than both plates. In such a case sidewall 47 or 49 would extend downward to near the paper mat 20. However, in practice I have found it generally desirable to utilize two plates which will move slightly to accommodate high spots in the paper mat thus insuring that the mat will not build up against a sidewall.

I claim:

1. A steam feeding system for distributing steam on a moving sheet of paper, the system comprising:

(a) a steam hood located above the sheet;

(b) a pipe to convey steam, coupled to the steam hood;

(c) a tube coupled in fluid-flow communication with said pipe;

(d) valve means coupled to said tube to control steam flowing from said pipe into said tube; and, (e) said valve means including a valve sleeve mounted in said tube, said valve being substantially cylindrical and having no piston ring located on said sleeve to contact said tube, said valve sleeve being spaced sufficiently apart from the interior of said tube to allow steam to flow between said valve sleeve and the interior of said tube when said valve sleeve is located in a maximum closed position, and said valve sleeve is movably mounted in said tube and is structured so that when said valve sleeve is located in a maximum open position said sleeve does not substantially restrict the flow of steam and when said sleeve is located in a maximum closed position said sleeve substantially restricts the flow of steam while allowing some flow of steam.

2. A system according to claim 1 wherein said sleeve has substantially smooth, straight sides throughout its entire length.

3. A system according to claim 1 wherein said valve means further includes:

(a) a plate member coupled to said sleeve;

(b) a rod coupled to said plate member; and (c) bellows means coupled to said rod to move said sleeve.

4. A system according to claim 1 wherein said valve sleeve is located in an uppermost position when the valve sleeve is in the maximum closed position, and said valve sleeve is located in a lowermost position when said valve sleeve is in the maximum open position.

* * * * *